United States Patent [19]

Todokoro

[11] 4,177,992

[45] Dec. 11, 1979

[54] BALL FLING-OUT STRUCTURE WITH PIVOTING GOALS

[76] Inventor: Masatoshi Todokoro, 2-33, Koganehara 2-chome, Matsudo-City, Chiba-Prefecture, Japan

[21] Appl. No.: 905,657

[22] Filed: May 15, 1978

[30] Foreign Application Priority Data

Feb. 4, 1978 [JP] Japan ..... 53-13235[U]

[51] Int. Cl.[2] ..... A63B 63/04; A63F 7/00

[52] U.S. Cl. ..... 273/101; 273/105.6; 273/105R; 124/79; 46/145

[58] Field of Search ..... 273/85 R, 85 C, 85 D, 273/85 E, 101, 105 R; 46/145; 124/4, 5, 79

[56] References Cited

U.S. PATENT DOCUMENTS

| | | | |
|---|---|---|---|
| 1,539,648 | 5/1925 | Chester et al. | 273/101 X |
| 1,681,682 | 8/1928 | McVey | 273/101 |
| 1,862,877 | 6/1932 | Andersen | 273/101 |
| 2,835,495 | 5/1958 | Lohr et al. | 273/101 |
| 3,269,055 | 8/1966 | Gordon | 46/145 |
| 3,481,605 | 12/1969 | Giraurd et al. | 46/145 |
| 3,834,701 | 9/1974 | Hashimoto | 273/85 C |

FOREIGN PATENT DOCUMENTS

| | | | |
|---|---|---|---|
| 1044204 | 11/1953 | France | 273/101 |

*Primary Examiner*—Richard C. Pinkham
*Assistant Examiner*—Lawrence E. Anderson
*Attorney, Agent, or Firm*—George B. Oujevolk

[57] ABSTRACT

A toy game board for playing a fling-ball-into-goal game, comprising a base board, elevated goals or ball-receiving structures provided centrally of the board, and animated ball-flipping structures arranged suitably at the periphery of the board, and so constructed that when a player presses a lever provided in each ball-flipping structure, a ball is flung out toward the goal.

2 Claims, 8 Drawing Figures

BALL FLING-OUT STRUCTURE WITH PIVOTING GOALS

This invention relates to a game board with which the children can play a fling-ball-into-goal game while enjoying the amusement created by the movement of the animated ball-flipping structure and joyfulness in pursuing the course of the flung ball. The game board is so constructed that when a player presses a lever provided in each ball-flipping structure having an animal or other figure and located at the periphery of the base board, the portion corresponding to the animal mouth is opened and a ball is flung out toward the goal provided in the center of the board.

The game board of this invention is now described in detail by way of an embodiment thereof with reference to the accompanying drawings, in which.

Figure 1:
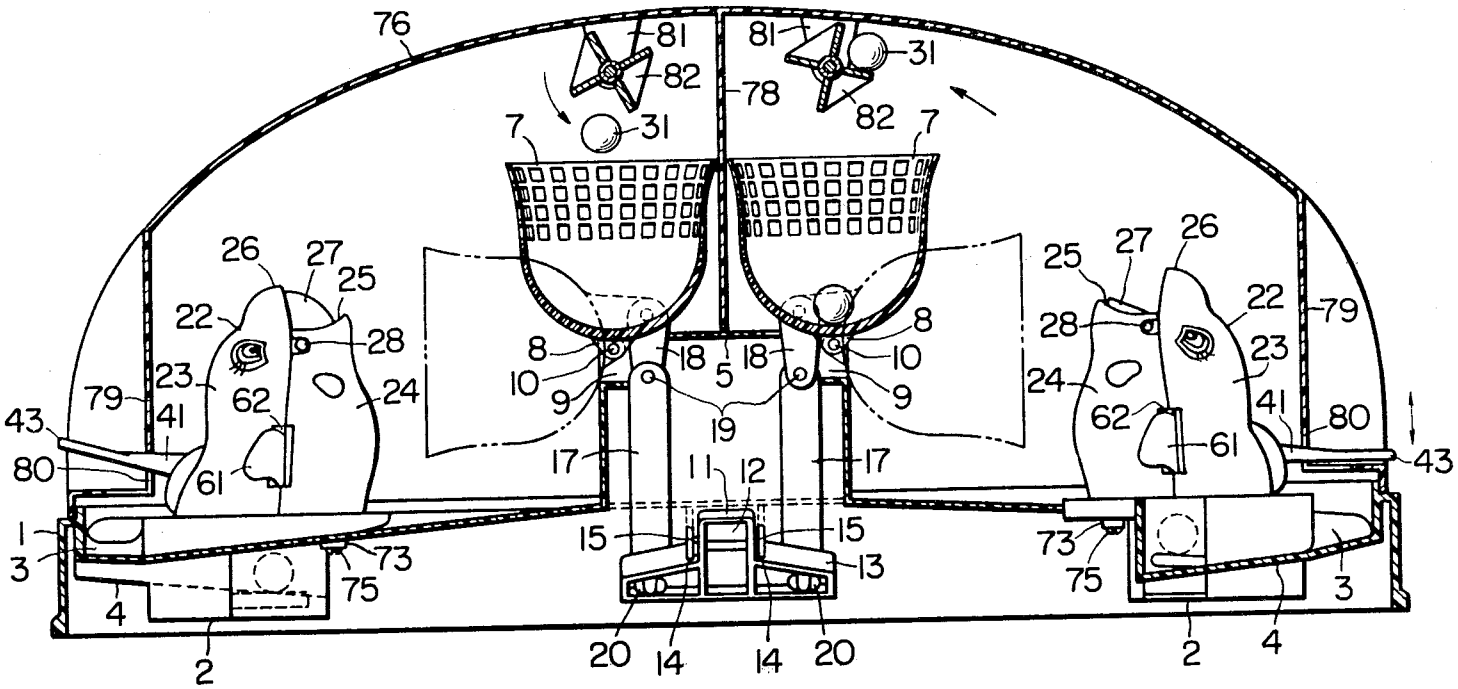
FIG. 1 is a vertical sectional view of a fling-ball-into-goal game board according to this invention.
Figure 2:
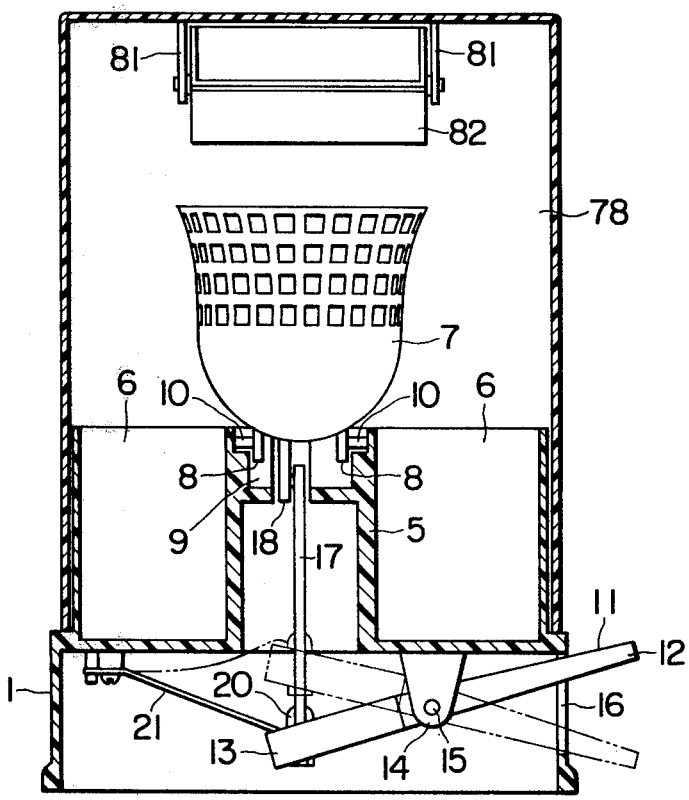
FIG. 2 is a cross-sectional side view thereof.
Figure 3:
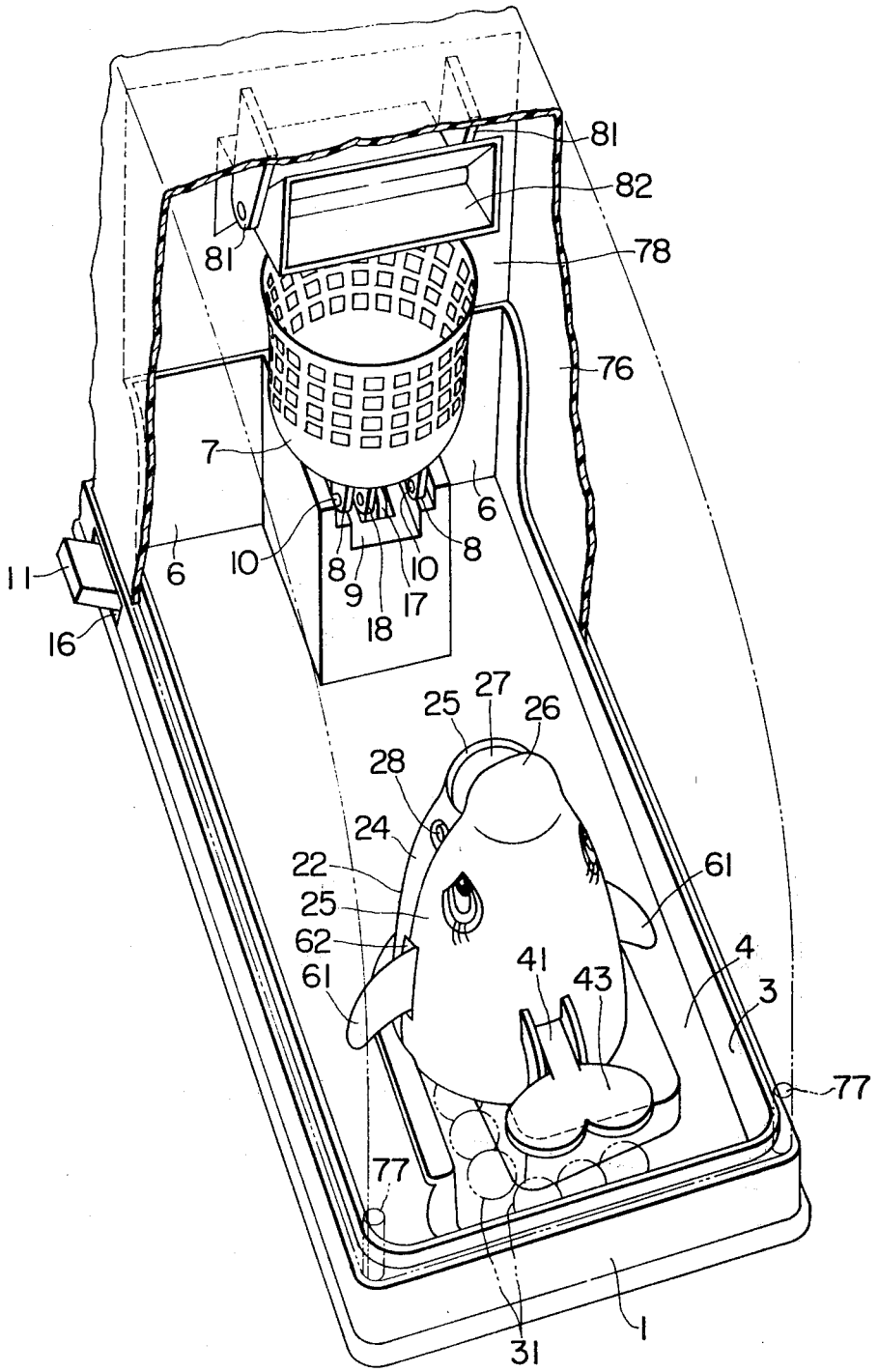
FIG. 3 is a perspective view of the game board, with parts cut out.

Referring generally to the drawings, reference numeral 1 indicates an elongated rectangular base board with a suitable height, said base board 1 having formed therein toward its both ends the recessions 2, 2 and channels 3, 3, each of said channels having a slant bottom 4 for rolling down the ball from the board surface into that part of the recession 2 which is positioned closer to the center of the board. Provided centrally on the board surface is a hollow rectangular parallelepipedal support structure 5. Partition walls 6, 6 are also provided centrally across the board surface, each of said partition walls extending from each side of said support structure 5 to the opposing side of the base board 1. Numeral 7 indicates goals or basket-like ball receiving structures each of which has provided at its bottom a suitable number of spaced-apart protuberances 8, 8 which are pivotally joined by pins 10, 10 to the inside walls of the recessions 9, 9 provided at both ends of the top surface of said support structure 5 so that each said basket-like structure can turn vertically. Numeral 11 refers to a lever for moving each said basket-like ball-receiving structure 7, said lever 11 consisting of a narrow elongated handle portion 12 and a wide portion 13 which are formed integral to each other. Both side portions toward the end of said handle portion 12 are pivotally joined by pins 15, 15 to the spaced-apart protuberances 14, 14 extending from the underside of the central portion of the base board 1, while the rear end of the handle portion 12 projects outside of the board 1 through a hole 16 formed centrally in one side of the board 1. The broad portion 13 of the lever 11 is positioned below the support structure 5. Secured to the wide portion 13 of the lever 11 by fastening means 20, 20 are the connecting bars 17, 17 each of which extends through the hollow portion of the support structure 5 and is pivotally joined at its other end by a pin 19 to a protuberance 18 extending between the above-said protuberances 8 from the bottom of each basket-like structure 7. Each of said connecting bars 17, 17 has a length sufficient to allow the basket-like structure 7 to take its erect position when the large-width portion 13 of the lever 11 has descended to its lowermost position by turning about the pivots 15, 15. 21 is a leaf spring of which one end is fixed to a central underside portion of the base board 1 while the other end is pressed against the upper surface of the broad portion 13 of the lever 11 to always urge said broad portion 13 to turn downwardly about the pivots 15, 15.

Numeral 22 indicates the hollow ball-flipping structures each of which is fixed above the recession 2. In the embodiments shown, each of said ball-flipping structure 22 has the figure of an upwardly facing dolphin and is so constructed that it is splittable into the back side portion 23 and the belly side portion 24. These "dolphins" may be suitably colored. For instance, they may be all colored in white at the external surfaces of the belly side portions 24 while colored differently from each other at the external surfaces of the back side portions 23. Each said structure 22 has at its top a mouth-like opening 25 through which the ball is to be flung out. This opening 25 is opened or closed by a cover 27 shaped like the lower jaw of the dolphin and pivotally joined at 28, 28 to the proximal parts of the portion 23 shaped like the upper jaw of the dolphin. Provided in each of said ball-flipping structure 22 is a track 29 along which the ball 31 is guided so that it is flung out from the opening 25 toward the goal 7. Said track 29 extends from the inside of the upper jaw 26 into the interior of the recession 2 by passing through an opening 30 provided in the bottom of the structure 22. A support plate 32 is provided for supporting the track 29 to prevent the ball 31 from coming off the track in its course of movement from the lower end of the track to the intermediate curved portion 32. 34 is a ball-flipping member provided in each said recession 2. Said ball-flipping member 34 is pivotted at its one end by a shaft 36 engaged at its both ends in the grooves 35 formed in both side walls of the recession 2 and extends from the rear side of the track 29 to the front side thereof by passing through a cutout in the lower part of the track 29, with the extended-out end forming a ball-receiving portion 37. The ball-flipping member 34 is also provided with another protuberance 38 on the side opposite from said ball-receiving portion 37. The ball-receiving portion 37 of the ball-flipping member 34 is always pressed against the bottom of the recession 2 by a leaf spring 39 which is integrally joined at its upper end to a U-shaped fixture 40 fitted in the groove 35, with the lower end of said leaf spring 39 being pressed against the upper side of the proximal end of the ball-receiving portion 37.

Numeral 41 refers to a lever for actuating said ball-flipping member 34, with one end of said lever 41 being fixed at a position corresponding to the protuberance 38 of the ball-flipping member 34 in the recession 2, while the other end of said lever 41 extends out through an opening 42 provided at that portion of the structure 22 which corresponds to the dorsal fin of the dolphin, and terminates into an end plate 43 shaped after the dolphin tail. The pivotal shaft 44 provided at the middle part of the lever 41 is engaged in the bearing holes 46, 46 which open at the ends of a pair of protuberances 45, 45 extending from both edges of the rear side of the track 29, and the ends of said protuberances 45, 45 are abutted against the corresponding ends of a pair of protuberances 47, 47 extending inwardly from the back side portion 23 of the ball-flipping structure 22 with the opening 42 interposed therebetween, whereby the openings of the bearing holes 46, 46 are closed to ensure pivotal support. The lever 41 is also provided with a square portion 48 disposed below the shaft 44. 49 is another leaf spring of which one end is held between the abutted ends of a protuberance 50 extending inwardly from the middle part of the back side portion 23 of the ball-flipping structure 22 and another protuberance 51 extending from the rear side of the track 29 and fixed by a screw 52 driven through the protuberance 51 into the protuberance 50 so as to concurrently serve for fixing the middle part of the track 29. The other end of said leaf spring 49 is pressed against the square portion 48 of the lever 41 so that one end of the lever 41 is always urged away from the protuberance 38 of the ball-flipping member 34. A pair of arm bars 53, 53 extend from both ends of the shaft 44 in parallel relation to each other toward the ball fling-out opening 25 in the ball-flipping structure 22. Provided at the external surface of each of said arm bars 53, 53 are a pair of slant protuberances 54, 54 (55, 55) with a space 56 therebetween, and bifurcated control bars 57, 57 are provided at the upper ends of said respective arm bars 53, 53. 58 indicates a pair of connecting bars each of which is secured at its one end to the pivotal shaft 28 of the opening cover 27 while the other end is pivoted by a pin 60 slidably fitted in the space 59 formed in the bifurcated control bar 57 so that when the ball-flipping member 34 is actuated by the lever 41, said cover 27 is moved from its closed position to its open position by said control bar 57. Plates 61, 61 shaped like dolphin's fins extend out from the holes 62, 62 formed in both sides of each ball-flipping structure 22. At both upper and lower ends of the plate portion inserted into the structure 22 are provided protuberances 63, 63 which are fitted into the corresponding pivotal holes 65, 65 of the support plates 64, 64 extending inwardly from both side walls of the ball-flipping structure 22 so that each said fin plate 61 is supported vibratably. Also provided at the middle part of the base edge of each fin plate 61 is a protuberance 66 whose end fits in the space 56 between the two slant protuberances 54, 54 (55, 55) provided on each arm bar 53.

67 is a protuberance extending from an upper inside part of the back side portion 23 of each ball-flipping structure 22, said protuberance 67 being in abutment against another protuberance 68 extending from the rear side of the track 29, and a screw 69 is driven through said protuberance 68 into the protuberance 67 to secure the upper portion of the track 29. Still another protuberance 70 projects out from a part intermediate the protuberances 50 and 67 on the inside of the back side portion 23 of each ball-flipping structure 22, said protuberance 70 being abutted against a protuberance 71 extending from the inside of the belly side portion 24 of the ball-flipping structure 22, and a screw 72 is driven through said protuberance 71 into the protuberance 70 to thereby join the back and belly side portions 23 and 24 of each ball-flipping structure 22. Extending from the underside of the base board 1 are the protuberances 73 which are hollowed centrally and fit on the corresponding protuberances 74 extending from the bottom of the respective ball-flipping structures 22. They are fixed in position by screw means 75. 76 is a half-circular transparent dome covering the entirety of the base board 1 and secured to the periphery of the base board 1 by means of screws threadedly driven into the tapped holes 77 provided at the bottom corners of the dome. Provided centrally in the inside of the dome 76 is a partition wall 78 which extends transversely between the goal (basket-like) structures 7, 7 and abuts on the top surface of the support structure 5. The space defined by the base board surface and the dome 76 is divided into two sections by said partition wall 78 and the aforesaid partition walls 6, 6. Toward both ends of the dome 76 are provided the vertical walls 79, 79 each of which has at its lower end an opening 80 through which the end plate 43 of each lever 41 extends to project outside of the dome 76. Extending downwardly from the ceiling of the dome 76 and parallel to the side walls thereof are two pairs of bearing plates 81, 81, each pair thereof being so arranged that they will be positioned just above the associated goal structure 7 when the latter is in its erect position. Pivotally mounted between each pair of said bearing plates 81, 81 is a vane wheel 82 consisting of four pieces of orthogonally arranged vanes.

In operation, when the balls 31 are put onto the board surface in each section of the base board 1, they roll down on the slant board surface and pass along each channel 3 toward the ball-receiving portion 37 at the end of each ball-flipping member 34. Only the leading ball 31 rides on the ball-receiving portion 37 and the succeeding balls 31 line up in order in each channel 3.

Figure 4:
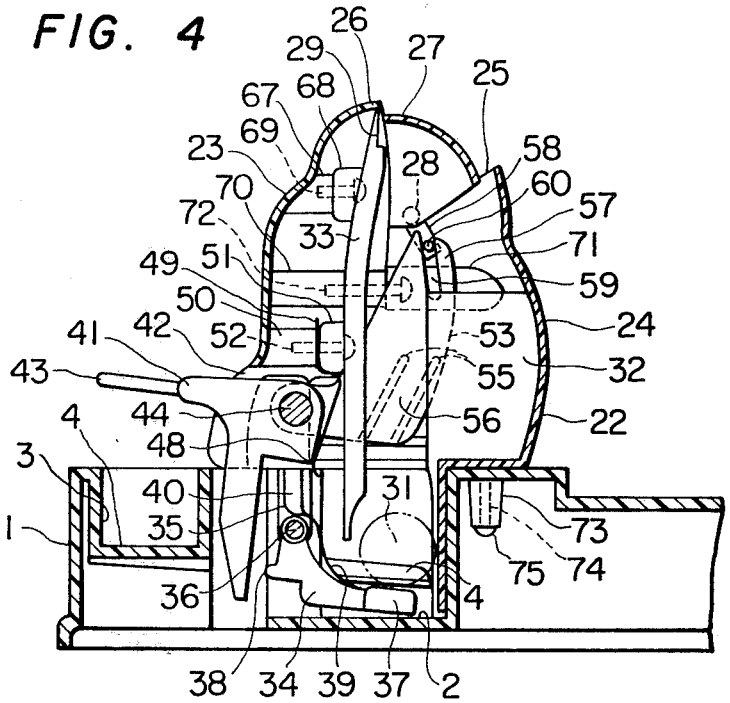
FIG. 4 is a partial enlarged vertical sectional view of a ball-flipping structure with the top opening cover being in its closed position.
Figure 7:
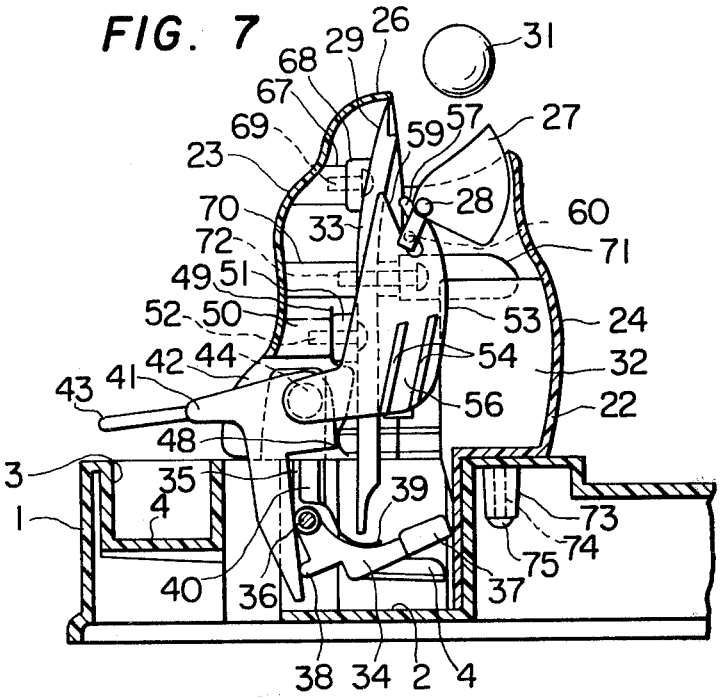
FIG. 7 is a partial enlarged vertical sectional view of the ball-flipping structure with the top opening cover being in its open position.

When a player presses down the end plate 43 of the lever 41, the portion of the lever 41 positioned in the recession 2 hits against the protuberance 38 of the ball-flipping member 34 against the elastic force of the leaf spring 39 as shown in FIG. 7, whereby the ball-receiving portion 37 of said ball-flipping member 34 is sprung up to fling up the ball 31 thereon while the arm bars 53, 53 and control bars 57, 57 are also turned up above the shaft 44 to force up the connecting bars 57, 57 about the shaft 28 to move the cover 27 from its closed position of FIG. 4 to its open position of FIG. 7 to open the ball fling-up port 25. Thus, the flipped ball 31 makes its way along the track 29 and flies out from the opening 25 toward the goal 7.

If the ball 31 is "properly" flung, it will directly dive into the goal 7 or get in between the vanes of the vane wheel 82. In the latter case, the vane wheel 82 turns due to the weight of the ball 31 to let the ball drop into the goal 7. If the ball is "improperly" flung, it will hit against the ceiling of the dome 76, an edge of a vane of the vane wheel 82, a side of the goal structure 7, etc., and drops onto the board surface. The ball which has dropped onto the board surface rolls down on the slant board surface to come at the end of the line of balls 31 drawn up in the channel 3.

As the end plate 43 of the lever 41 is freed of its load immediately after the ball 31 is flung out, the portion of the lever 41 inserted into the recession 2 is forced back to its original position under the elastic force of the leaf spring 49 as shown in FIG. 4. The ball-flipping member 34 also returns to its original position under the elastic force of the leaf spring 39, and the next ball 31 rides on the ball-receiving portion 37. Simultaneously, the arm bars 53, 53 and control bars 57, 57 return to their original positions to force down the connecting bars 58, 58 to let the cover 27 move from its open position of FIG. 7 to its closed position of FIG. 4, thereby closing the ball fling-out opening 25.

Figure 5:
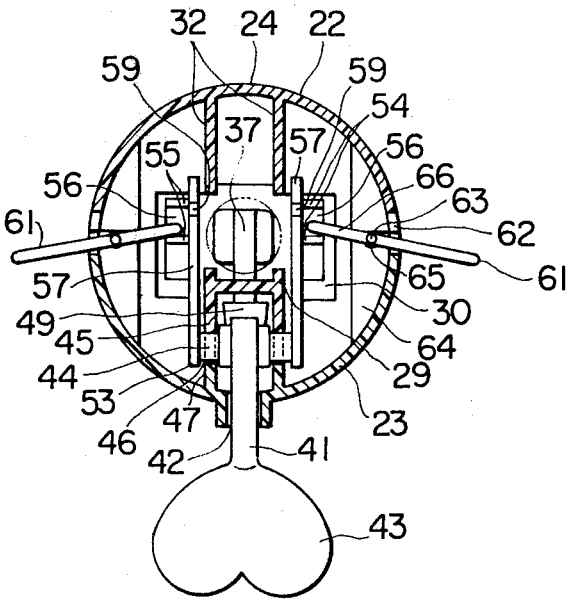
FIG. 5 is a partial cross-sectional view of FIG. 4.
Figure 6:
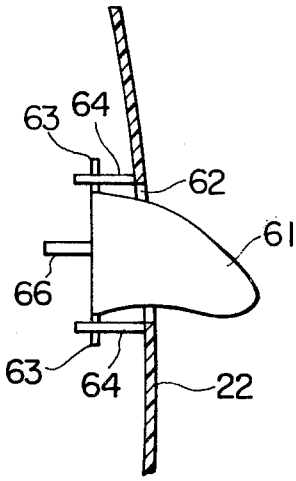
FIG. 6 is a drawing illustrating a mode of fixing a fin.
Figure 8:
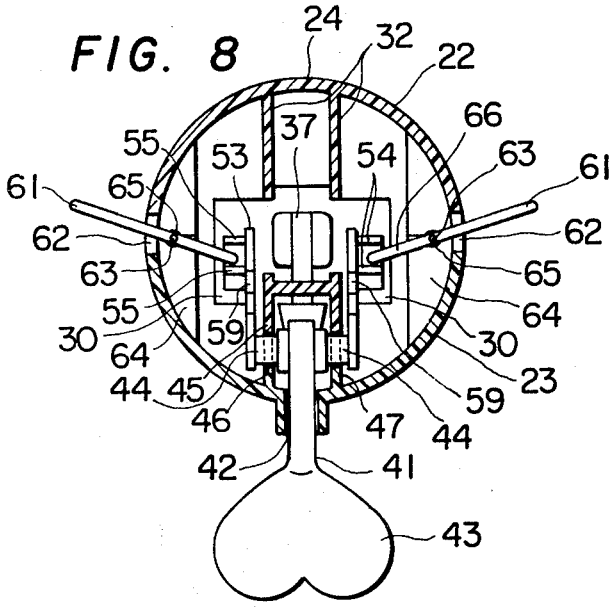
FIG. 8 is a partial cross-sectional view of FIG. 7.

In the above-said operation, when the arm bars 53, 53 spring up, the slant protuberances 54, 54 (55, 55) are forced to turn about the shaft 44 to move from the position of FIG. 4 to the position of FIG. 7, causing the protuberance 66 of the fin plate 61 to turn about the protuberance 63 to move from the position of FIG. 5 to the position of FIG. 8, and when said arm bars 53, 53 return to the original positions, the slant protuberances 54, 54 (55, 55) are forced to move from the position of FIG. 7 to the position of FIG. 4, causing the protuberance 66 of the fin plate 61 to turn about the protuberance 63 to move from the position of FIG. 8 to the position of FIG. 5. Thus, the portion of each fin plate 61 exposed outside of the ball-flipping structure 22 vibrates to and fro.

Each player presses the end plate 43 of the lever 41 repeatedly to repeat the above-said operation, thus competing with the other player in flinging as many balls into the goal as possible. The player who has successfully got more balls into the goal than the other player(s) is the winner.

When the game is over, the rear end of the handle portion 12 of each lever 11 is depressed against the force of the leaf spring 21 to push up the connecting bar 17 through the broad portion 13 of the lever 11, causing the basket-like goal structure 7 to turn down about the pivot 10 as shown by dotted lines in FIG. 1, letting the balls 31 in each structure 7 drop onto the base board 1. When the depression on the lever 11 is released, the lever 11 is forced back to its original position under the elastic force of the leaf spring 21, allowing the goal structure 7 to restore its erect position to stay ready for the next game.

According to the foregoing embodiment of this invention, all the component parts except for the ball-flipping member 34 can be incorporated in the ball fling-out structure 22, so that assemblage of the ball fling-out structure 22 and its fitting to the base board 1 are even more facilitated. Also, since the ball-flipping member 34, after sprung up, is quickly and positively returned to its original position under the elastic force of the leaf spring 39, the movement of said ball-flipping member 34 won't retard and no "mis-flip" of the ball is caused even if the balls are flipped continuously. Further, since the space defined by the surface of the board 1 and the dome 76 is divided into two sections by the partition walls 6, 6 and 78, it is possible to play the fling-ball-into-goal game for each section, and there is no possibility that the ball(s) 31 flung out from one ball fling-out structure 22 be mixed with the ball(s) from the other ball fling-out structure 22. If desired, the space defined by the board surface and dome 76 may not be partitioned so that the ball 31 may get into any of the goals.

In the above embodiment, each ball fling-out structure is shaped like a dolphin, but this structure may be formed into any desired figure, and in such case, the top opening cover is given a corresponding shape and there are provided the operating parts which can effectuate a typical motion of the particular figure in correspondence with the opening and closing movement of the cover. The configuration of the base board and dome, the number of the ball fling-out structures and the form of their arrangement on the board surface may be suitably altered in accordance with the shape of the board.

As described above, this invention provides a very amusing game board with which the children can enjoy, beside the get-ball-into-goal game itself, the amusingness created by the motion of the animated figure of each ball fling-out structure (such as vibration of the fin plates while the dolphin mouth is closed after it was opened for allowing fling-out of the ball as in the shown embodiment) and joyfulness in pursuing the course of the ball while wondering whether the ball will get into the goal or not. The ball which failed to get into the goal structure is checked by the dome from flying out of the board and drops onto the board surface, while the ball which got into the goal structure is dropped onto the board by turning over the basket-like goal structure, and all the balls which dropped onto the board surface are urged to roll down toward the ball flipping member by passing the channel at the end of the board. Thus, there is no need for the player to collect the balls, and there is also no fear of losing the balls either during the play or when the board is not in use, and the players can play the fling-ball-into-goal game continuously by merely operating a lever.

What is claimed is:

1. A game board arrangement wherein balls disposed towards the outer periphery of a game board are flung out of an animated head into a basket centrally located on the game board, comprising in combination:

(a) a base board (1) with a board center and board ends, recessions (2) extending from said board ends towards said board center and channels (3) for rolling balls into a part of said recession positioned closer to said board center;

(b) a plurality of basket-like ball-receiving goal structures (7) pivotally mounted in the center of the base board (1) so that said structures can freely turn from a horizontal to a vertical and from a vertical to a horizontal position;

(c) a lever (11) connected to said goal structures so that said structures may be turned from the vertical to the horizontal position by the operation of said lever;

(d) ball fling-out structures (22) disposed towards the periphery of the base board, each of said ball fling-out structures (22) being shaped like an animal or fish with a ball fling-out mouth-like opening (25) having a cover (27) at the top of each of said ball fling-out structures such that the fling-out opening (25) is opened and closed by said cover (27), a ball fling-out member positioned in each of said recessions (2);

(e) a track (29) provided in each of said ball fling-out structures for guiding the flung-out ball so that a ball (31) will be flung out from said opening (25) towards the goal structure;

(f) a lever (41) extending below said track for actuating said ball-fling member (34), control bars connected between said lever and said cover for moving said cover from its closed position to its open position when the ball fling-out member (34) is actuated by said lever (41), channels provided at the ends of the base board for guiding the balls from the board surface towards each of said ball fling-out members (34);

(f) a transparent dome covering the entirety of the upper side of the board; and, (g) a vane wheel (82) mounted to said dome over said goal structure (7) so that a ball (31) flung out from said fling-out structures (22) can hit said vane wheel and drop into said goal structure (7).

2. A game board according to claim 1, wherein the space defined by the surface of the base board and the dome is divided into two or more sections by partition walls, and a ball fling-out structure and a ball-receiving goal structure are provided in each of said sections.

* * * * *